United States Patent [19]

Donohoe

[11] 4,320,688

[45] Mar. 23, 1982

[54] SYNTHETIC DRUMSTICK AND METHOD OF PRODUCING SAME

[75] Inventor: David G. Donohoe, Corona, Calif.

[73] Assignee: Aquarian Accessories Corporation, Anaheim, Calif.

[21] Appl. No.: 213,821

[22] Filed: Dec. 8, 1980

[51] Int. Cl.[3] ..... G10D 13/02

[52] U.S. Cl. ..... 84/422 S

[58] Field of Search ..... 84/422 S

[56] References Cited

U.S. PATENT DOCUMENTS

| | | | |
|---|---|---|---|
| 3,146,659 | 9/1964 | Robba et al. | 84/422 S |
| 3,165,964 | 1/1965 | Stys et al. | 84/422 S |
| 3,175,450 | 3/1965 | Criscuolo | 84/422 S |
| 3,489,052 | 1/1970 | Colyer et al. | 84/422 S |
| 3,722,350 | 3/1973 | Cordes | 84/422 S |
| 3,958,485 | 5/1976 | Peters | 84/422 S |
| 4,047,460 | 9/1977 | Fiedler et al. | 84/422 S |
| 4,246,826 | 1/1981 | Warrick et al. | 84/422 S |

*Primary Examiner*—Lawrence R. Franklin

*Attorney, Agent, or Firm*—Francis X. LoJacono

[57] ABSTRACT

A synthetic drumstick, including a method of producing the same, so as to provide the feel, handling and contour of a natural wooden drumstick, the synthetic drumstick being formed from a central hollow core having a predetermined length, short of the normal striking area of the stick, at which point a flexible tapered stud member is inserted in the core end. A glass-filled nylon skin is molded over both the central core and the flexible stud member, a striking tip being formed from the molded skin as an integral part of the drumstick. A second embodiment is also disclosed wherein the neck portion of the flexible stud extends outwardly of the outer skin body, whereby various sizes of striking tips may be secured thereto.

5 Claims, 10 Drawing Figures

SYNTHETIC DRUMSTICK AND METHOD OF PRODUCING SAME

BACKGROUND OF THE INVENTION

1. Field of the Invention

This invention relates generally to a drumstick, but more particularly to an improved synthetic drumstick and method of producing the same. The drumstick has the characteristics of a typical wooden drumstick, but without the well known inherent problems associated with wooden drumsticks.

2. Description of the Prior Art

It is well known in the art that various problems and difficulties are encountered in providing a drumstick that is capable of withstanding the severe abuse under the playing techniques demanded of present-day percussionists.

Many types of synthetic drumsticks have been and are presently being employed. However, because of inherent problems with these composition sticks, solid wooden drumsticks still prevail as the most conventional type employed by percussionists, particularly professional drummers. These drummers require a standard of drumsticks that—until the present time—could only be provided by drumsticks fabricated from high-strength hardwoods, such as hickory. Thus, through the years such wooden-type sticks have found great favor with percussionists because of the optimum results in sound-producing when striking a drum, and the feel that is established by proper weight distribution. Also, before the advent of the present device, flexural characteristics could not be duplicated by synthetically formed drumsticks.

It is well recognized that weight distribution, flexural characteristics (particularly in the forward striking portion of the stick), balance, and a straight cylindrical shaft are the most important criteria in selecting a pair of matched drumsticks. Accordingly, the above criteria determines the "feel" of a drumstick to the drummer. In other words, the drummer selects a matching pair of sticks according to the proper "feel" which would allow him to smoothly execute his complicated actions while playing.

It is important to note that drum instruments are presently being employed in contemporary music as more than a means of producing rhythm. The drumsticks are used in a more active and dramatic fashion, causing normal or typical wood-formed sticks to wear, splinter and break within a matter of hours—rather than days or weeks as had been the case in the past. Thus, the inherent short life span of a wooden stick is now shortened even more, making is necessary for the drummer to carry a large number of stick replacements.

As examples of various types of drumsticks replacing the wooden sticks, one may look to the following United States patents.

U.S. Pat. No. 3,722,350 to Cordes discloses a drumstick comprised of a hollow, cylindrical metal tube (open at both ends) having a plastic open tip secured to the butt end thereof, whereby variations in sound characteristics may be achieved by changing the length of the reduced-diameter, cylindrical tip portion.

U.S. Pat. No. 2,521,336 to Bramson discloses a tubular drumstick filled with a plurality of balls held against longitudinal movement in the handle, so that the overall weight of the filler can be varied.

U.S. Pat. No. 3,958,485 to Peters discloses a hollow drumstick that includes a plurality of longitudinally disposed internal ribs for increasing stiffness and vibration dampening.

U.S. Pat. No. 3,489,052 to Colyer, et al, discloses a drumstick having a hollow, inner reinforcing tub, preferably of aluminum, wherein fiber-reinforced resin sheets are formed in a desired pattern and wrapped on the tub, after which a heat-shrinkable, thin-film pressure tape is wrapped over the plastic sheets and together are heat cured to define an integral hollow structure comprising an inner and outer tube.

There also have been numerous attempts to provide suitable substitute drumsticks for the standard wooden-type drumsticks by chemically treating the wood. Other attempts have been made at utilizing metals, plastics and reinforced plastics to overcome the problems of weight, flexure and sound quality—but in each case these objectives have not been fully accomplished.

SUMMARY AND OBJECTS OF THE INVENTION

Therefore, the present invention has for an important object to provide a synthetic drumstick that meets all the longstanding requirements of the percussionist, wherein feel, weight, sound-reproduction and quality are all established in a unique construction having a central core adapted with a solid, flexible, tapered stud member, both members being covered with a molded skin, and wherein the tip may be integrally formed as part of the molded skin or as a separate insert of a desired configuration to satisfy the requirements of the drummer.

It is another object of the invention to provide a drumstick of this character wherein the weight of the stick is placed in the strike area, to establish an accurately clear and sharp response of the drum or other percussion instrument.

It is still another object of this invention to provide a new and improved synthetic drumstick to include a striking end portion which is formed by a solid, flexible, tapered stud that allows the stick to respond in a unique quick action which exceeds that which was obtainable in the prior art.

Still another object of this invention is to provide a drumstick of this character that allows for a simple method of interchanging various sizes and configurations of tips, whether the tip is formed as in integral part thereof or as an interchangeable element.

A further object of the present invention is to provide a synthetic drumstick that establishes an "acoustical" design to deliver a matched tone, quality and projection when drumsticks are paired.

Still another object of the invention is to provide a drumstick of this character that is uniquely constructed to allow superior rim-shot sound, with maximum durablity.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
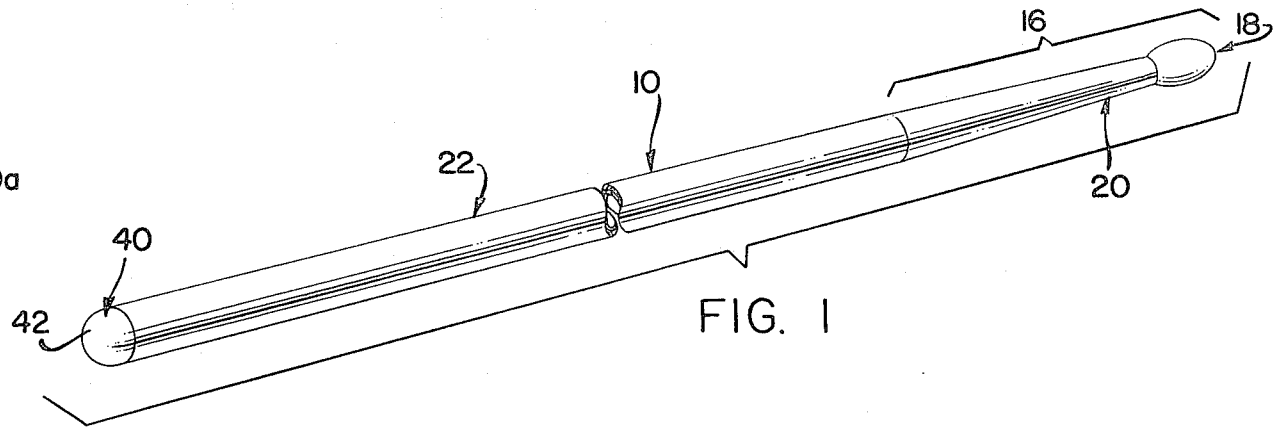
FIG. 1 is a perspective view of the present invention having a portion thereof broken away.
Figure 2:
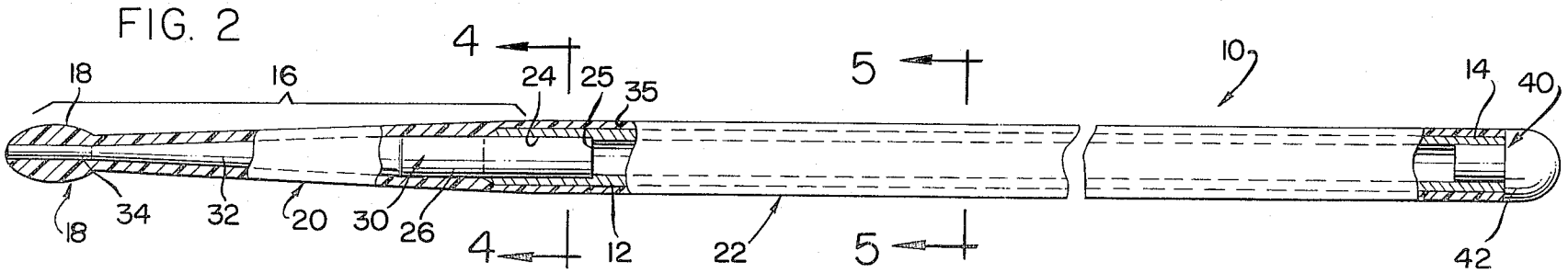
FIG. 2 is a side-elevational view of the new and improved synthetic drumstick having portions thereof broken away to clearly show the elements of construction of the drumstick.

Referring more particularly to the drawing FIGS. 1 and 2, there is shown a preferred embodiment of the new and improved synthetic drumstick, the stick generally indicated at 10 being formed having a central core 12 defining a hollow-tube member which extends forwardly from the butt end 14 at approximately the striking area of the drumstick, the striking area being indicated by bracket 16. When referring to the striking area 16 of drumstick 10, it is the area that includes striking head or tip 18 and the forward tapered neck portion 20 defined between the tip and the cylindrical handle or shaft portion, designated generally at 22.

Accordingly, the shaft or handle portion must be constructed in a substantially rigid manner, the central core 12 being preferably made from a tubular graphite material or graphite reinforced plastic resin wherein the graphite fibers are oriented longitudinally from the tubular core 12. Other reinforcing fibers are also contemplated. These may be glass or other high-strength fiber materials. Aluminum and/or magnesium are further contemplated for fabricating the central core.

The forward end of core 12 is countersunk to provide an enlarged bore 24 and an annular shoulder 25. The enlarged bore 24 is adapted to receive the enlarged-diameter shank portion 26 of a flexible stud, indicated at 30. Thus, stud 30 is suitably bonded to core 12 whereby stud 30 assists in defining the striking area 16. Stud 30 is further formed having an intermediate tapered body 32, which terminates with an integrally formed small-diameter dowel 34. It is contemplated that various suitable materials can be employed for making the stud; however, any material selected must provide the flexibility which has been found to be essential to the proper response of the stick, so as to establish a response when striking a drum that is equal to or greater than with a typical wooden drumstick. Preferably, a solid, tapered fiberglass material is contemplated, but a swaged aluminum or magnesium tubing could be substituted and still have the various desired effects.

FIG. 2 illustrates an outer cylindrical body 35 formed to cover and encapsulate both the central core 12 and the extended stud 30, so as to provide a unitized structure. It should be further noted that this embodiment includes an integrally formed striking tip or head 18 which is arranged to be supported by dowel 34.

The cylindrical body is preferably molded from a glass-filled nylon skin extending the full length of the central core and the stud, thereby defining an integrally formed handle, striking area and striking tip.

Striking core 16 is so termed due to the fact that the principle striking member is the tip or head 18, the tapered intermediate neck portion 20 being used for striking the rim of the drum, which is known as a "rim shot". The neck portion of a wooden stick is generally the area which becomes chipped and worn; and very often the portion just behind the tip will wear, causing the tip to break off. The above-described construction thus provides a life span for the drumstick which is increased considerably over that which is available at the present time; and it also allows a greater response, together with a greater control of balance and forward weight displacement.

Figure 6:
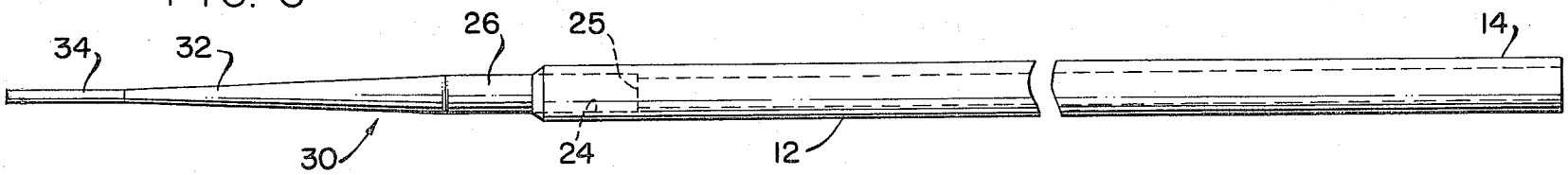
FIG. 6 is an elevational view of the inner central core member showing the extended flexible stud member secured therein, which defines the striking area of the stick.
Figure 7:
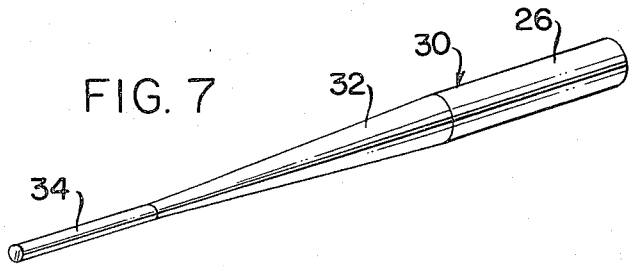
FIG. 7 is a perspective view of the flexible stud member.
Figure 8:
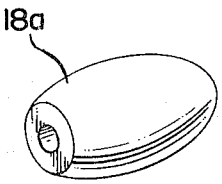
FIG. 8 is an alternative arrangement of the tip.
Figure 9:
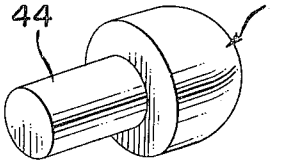
FIG. 9 is a perspective view of the end cap which provides the enlarged striking butt of the stick.

When more forceful and greater action in playing is required, the rear end of the drumstick is generally used to strike the drum. Thus, there is included a molded insert defined by a shank butt member 40 comprising an enlarged head 42 (having the same diameter as the handle) and an extended reduced-diameter boss 44. (See FIGS. 2 and 9.) Boss 44 is bonded to the drumstick, the boss being positioned within the rear open end of the handle and also formed from a nylon plastic material similar to that of tip 18.

Figure 3:
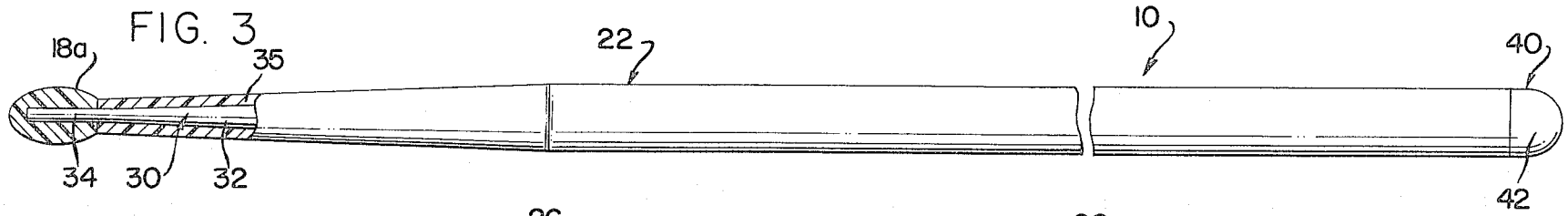
FIG. 3 is a side-elevational view of the drumstick having the striking end shown in section to illustrate a different arrangement of the striking tip.
Figure 5:
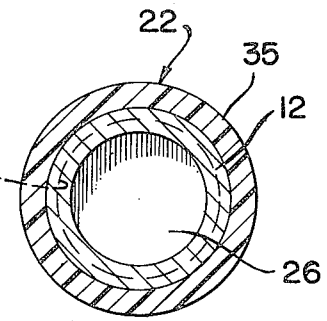
FIG. 5 is an enlarged cross-sectional view taken along line 5—5 of FIG. 2.
Figure 4:
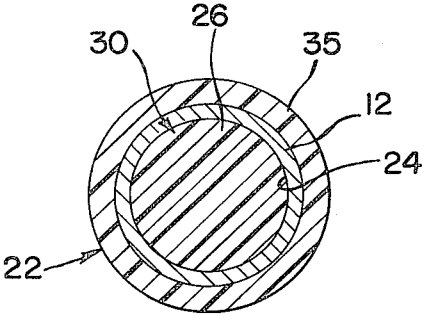
FIG. 4 is an enlarged cross-sectional view taken along line 4—4 of FIG. 2.

Referring now to FIG. 3, the drumstick 10 is made as hereinabove described with the exception that tip **18*a* is formed as a separate member which is attached to dowel 34. In this arrangement, dowel 34 is not fully covered by the nylon skin of body 35**.

Thus, tip **18*a* will be formed from a nylon material having excellent wear and fracture resistant qualities. However, other suitable materials may be interchanged, such as tips formed of natural hardwood. Once the tip 18*a* is bonded to dowel 34, tip 18*a*** becomes an integral part of the stick. This arrangement allows for a more simple method of providing varying stick designs to accommodate the individual preferences of the percussionists.

Figure 10:
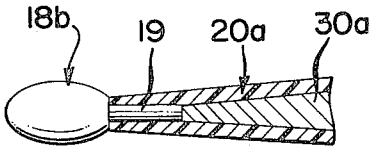
FIG. 10 is a view of the striking end of the stick having still another arrangement of the tip member.

FIG. 10 further illustrates another method of introducing a variety of tips, such as tip **18*b* which has an extended pin 19 formed as a part thereof, wherein stud 30*a* is not provided with an extended dowel member. Pin 19 would, therefore, be bonded in the open end of the tapered neck portion 20*a***.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A synthetic drumstick defining a striking area and a handle portion, comprising:

a rigid, hollow, tubular core member of a predetermined length forming a part of said handle portion, and having an open front end terminating at the striking area and a rear open end, said front end being formed having an enlarged bore;

a flexible, tapered, solid stud member adapted to be affixed in said open front end of said core, said stud member forming a part of said striking area and comprising an enlarged rear body portion adapted to be fixedly received in said enlarged bore of said core member, an intermediate tapered body portion and a reduced-diameter-dowel-body portion defining a free end of said stud member;

a molded plastic skin member formed about said core and said flexible, tapered stud member;

a striking tip affixed to the rear open end of said core, in order to define a rear striking head and to close said open end to prevent a vibrating sound when struck;

said core member being formed from a fiber-impregnated plastic material, said flexible tapered stud member being formed from a fiberglass-impregnated plastic material, providing flexible characteristics to said stud member, and said molded plastic skin member being formed from a glass-filled nylon material molded about said core and said stud after said stud is secured to said core.

2. A synthetic drumstick as recited in claim 1, wherein said striking tip is integrally formed as part of said molded skin.

3. A synthetic drumstick as recited in claim 1, wherein said striking tip is affixed and bonded to said reduced-diameter-dowel body portion of said stud member.

4. A synthetic drumstick as recited in claim 3, wherein said tip is formed from a nylon plastic material.

5. A synthetic drumstick as recited in claim 1, wherein said fiber of said core consists of a graphite material.

* * * * *